US006435347B1

(12) United States Patent
Brown

(10) Patent No.: US 6,435,347 B1
(45) Date of Patent: Aug. 20, 2002

(54) CONTAINER FOR FRESHLY HARVESTED RESPIRING, LEAFY PRODUCE

(75) Inventor: Richard S. Brown, Chualar, CA (US)

(73) Assignee: Fresh Express, Incorporated, Salinas, CA (US)

( * ) Notice: Subject to any disclaimer, the term of this patent is extended or adjusted under 35 U.S.C. 154(b) by 0 days.

(21) Appl. No.: 09/507,501

(22) Filed: Feb. 18, 2000

(51) Int. Cl.[7] ..... B65D 19/00

(52) U.S. Cl. ..... 206/386; 220/8; 229/117.28

(58) Field of Search ..... 206/541, 542, 206/806, 386; 229/101, 108, 109, 117.09, 117.26, 117.28, 120.01; 220/4.26, 4.27, 8, 23.9, 23.87, 23.89, 495.03

(56) References Cited

U.S. PATENT DOCUMENTS

| | | | | |
|---|---|---|---|---|
| 910,882 | A | | 1/1909 | Truesdell |
| 1,661,602 | A | | 3/1928 | Dary |
| 2,003,326 | A | | 6/1935 | Wellman |
| 2,170,378 | A | | 8/1939 | Orstrom |
| 2,214,944 | A | | 9/1940 | Vogt |
| 2,294,668 | A | | 9/1942 | Karas |
| 2,335,913 | A | | 12/1943 | Buttery |
| 2,424,693 | A | | 7/1947 | Jones |
| 2,611,709 | A | | 9/1952 | Plagge |
| 2,627,862 | A | | 2/1953 | Flusher |
| 2,815,621 | A | | 12/1957 | Carter |
| 2,920,967 | A | | 1/1960 | Heinemann |
| 2,925,210 | A | | 2/1960 | Fallert |
| 2,955,940 | A | | 10/1960 | Williams |
| 2,967,777 | A | | 1/1961 | Grindrod |
| 3,055,568 | A | | 9/1962 | Zalking |
| 3,128,934 | A | | 4/1964 | Jacke |
| 3,203,437 | A | | 8/1965 | Faust |
| 3,204,825 | A | | 9/1965 | Underwood |
| 3,220,157 | A | | 11/1965 | Buchner |
| 3,261,533 | A | | 7/1966 | Ripking |
| 3,361,323 | A | * | 1/1968 | Adams et al. ..... 229/109 X |
| 3,407,078 | A | | 10/1968 | Schlichter |
| 3,419,400 | A | | 12/1968 | Hayhurst et al. |
| 3,450,542 | A | | 6/1969 | Badran |
| 3,473,589 | A | | 10/1969 | Gotz |
| 3,484,017 | A | | 12/1969 | O'Donnell |
| 3,521,806 | A | | 7/1970 | Esty |
| 3,715,860 | A | | 2/1973 | Esty |
| 3,747,614 | A | | 7/1973 | Buedingen |
| 3,768,720 | A | * | 10/1973 | Bundy ..... 229/117.26 |
| 3,939,287 | A | | 2/1976 | Orwig et al. |
| 3,945,558 | A | | 3/1976 | Elder |
| 3,957,179 | A | | 5/1976 | Bamburg et al. |
| 3,990,358 | A | | 11/1976 | Cade |
| 3,991,543 | A | | 11/1976 | Shaw |
| 4,001,443 | A | | 1/1977 | Dave |
| 4,006,561 | A | | 2/1977 | Toma et al. |
| 4,013,168 | A | * | 3/1977 | Bamburg et al. ..... 229/109 X |
| 4,039,350 | A | | 8/1977 | Bucy |

(List continued on next page.)

FOREIGN PATENT DOCUMENTS

| | | |
|---|---|---|
| CA | 1025786 | 2/1978 |
| DE | 2842204 | 4/1980 |
| EP | 025334 | 1/1988 |
| GB | 402436 | 12/1933 |
| GB | 764796 | 1/1957 |
| GB | 1378140 | 12/1974 |
| JP | 60-126032 | 7/1985 |

OTHER PUBLICATIONS

Wiley Encyclopedia of Packaging Technology J. Wiley & Sons, 1986 pp. 24–29, 66–81.

(List continued on next page.)

*Primary Examiner*—David T. Fidei

(57) ABSTRACT

A container for fresh produce including a base unit with a bottom wall and four to eight side walls and a sleeve with four to eight side walls that fits frictionally within the base unit. The base unit has a height that is at least about twenty-five percent the height of the sleeve.

5 Claims, 1 Drawing Sheet

U.S. PATENT DOCUMENTS

| | | | | |
|---|---|---|---|---|
| 4,055,931 | A | | 11/1977 | Myers |
| 4,061,785 | A | | 12/1977 | Nishino et al. |
| 4,066,401 | A | | 1/1978 | Solomon |
| 4,079,152 | A | | 3/1978 | Bedrosian et al. |
| 4,089,417 | A | | 5/1978 | Osborne |
| 4,105,153 | A | | 8/1978 | Locke |
| 4,168,597 | A | | 9/1979 | Cayton |
| 4,209,538 | A | | 6/1980 | Woodruff |
| 4,224,347 | A | | 9/1980 | Woodruff |
| 4,241,558 | A | | 12/1980 | Gidewall et al. |
| 4,258,848 | A | | 3/1981 | Akao et al. |
| 4,268,555 | A | | 5/1981 | Kantz |
| 4,296,860 | A | | 10/1981 | Hsu et al. |
| 4,343,429 | A | | 8/1982 | Cherry |
| 4,411,921 | A | | 10/1983 | Woodruff |
| 4,422,466 | A | | 12/1983 | Schafer |
| 4,423,080 | A | | 12/1983 | Bedrosian et al. |
| 4,454,945 | A | | 6/1984 | Jabarin |
| 4,515,266 | A | | 5/1985 | Myers |
| 4,516,692 | A | | 5/1985 | Croley |
| 4,610,885 | A | | 9/1986 | Tait |
| 4,670,227 | A | | 6/1987 | Smith |
| 4,702,408 | A | | 10/1987 | Powlenko |
| 4,744,199 | A | | 5/1988 | Gannon |
| 4,744,203 | A | | 5/1988 | Brockwell et al. |
| 4,756,417 | A | | 7/1988 | Teixeira |
| 4,759,642 | A | | 7/1988 | Van Erden et al. |
| 4,813,791 | A | | 3/1989 | Cullen et al. |
| 4,834,255 | A | * | 5/1989 | Boots ..... 229/109 X |
| 4,840,271 | A | | 6/1989 | Garwood |
| 4,863,287 | A | | 9/1989 | Marisk |
| 4,886,372 | A | | 12/1989 | Greengrass et al. |
| 4,930,906 | A | | 6/1990 | Hemphill |
| 4,962,777 | A | | 10/1990 | Bell |
| 4,963,287 | A | | 10/1990 | Hutchings et al. |
| 4,967,776 | A | | 11/1990 | Folmar |
| 5,044,776 | A | | 9/1991 | Schramer et al. |
| 5,078,509 | A | | 1/1992 | Center et al. |
| 5,093,080 | A | | 3/1992 | Keller |
| 5,121,589 | A | | 6/1992 | Ventura et al. |
| 5,226,972 | A | | 7/1993 | Bell |
| 5,290,580 | A | | 3/1994 | Floyd et al. |
| 5,316,778 | A | | 5/1994 | Hougham |
| 5,346,089 | A | | 9/1994 | Brown et al. |
| 5,354,569 | A | | 10/1994 | Brown et al. |
| 5,402,906 | A | | 4/1995 | Brown et al. |
| 5,421,250 | A | | 6/1995 | Beaumont |
| 5,437,731 | A | | 8/1995 | St. Martin |
| 5,522,410 | A | | 6/1996 | Meilleur |
| 5,640,643 | A | | 6/1997 | Hoitz et al. |
| 5,713,101 | A | | 2/1998 | Jackson |
| 5,727,690 | A | | 3/1998 | Hofmeister |
| 5,728,439 | A | | 3/1998 | Carlblom et al. |
| 5,885,002 | A | | 3/1999 | Reiss |
| 5,954,067 | A | | 9/1999 | Brown et al. |
| 6,041,797 | A | | 3/2000 | Casselman |

OTHER PUBLICATIONS

Packaging, Japan, Nov. 198, pp. 17–22 (Date unknown).
Chemcial Engineering, vol. 64 (Date unknown).
Modern Packaging, Aug. 1941, pp. 44, 45.
"The King PAK" eight sided fiberboard IBC from Packaging Review, May 1980, 1 page.
The Wiley Encyclopedia of Packaging Technology (WFPT), John Wiley & Sons, 1986, p. 493.

* cited by examiner

CONTAINER FOR FRESHLY HARVESTED RESPIRING, LEAFY PRODUCE

This invention relates to two-part bulk containers for freshly harvested, respiring produce such as Iceberg lettuce and Romaine lettuce. The containers include two parts: a base unit having a bottom wall and four to eight side walls, and a sleeve that fits frictionally inside the base unit. This sleeve is open at both ends and also has from four to eight side walls. In some embodiments, the base unit is attached to a pallet, as by gluing or by fasteners. In preferred embodiments, the base unit has a height in the range of about twelve to about forty-eight inches from the bottom wall to the opening formed at the top of the side walls. Preferably, the sleeve has a height in the range of about twenty-seven inches to about ninety inches. Preferably, the circumference of the base member, and of the sleeve, is in the range of about one hundred fifty inches to about one hundred ninety inches. Preferably, the internal volume of the container is in the range of about thirty to about one hundred forty cubic feet. These containers can, in preferred embodiments, hold up to about two thousand pounds of Iceberg lettuce.

Preferably, the base unit has four walls to eight walls, and is made of corrugated, waxed or unwaxed fiber board, plastic or metal. Plastic base units can be rotationally molded, collapsible, and/or corrugated.

The sleeve is preferably made of the same material as the base unit. Thus, the sleeve can be made of corrugated, waxed or unwaxed fiber board, plastic or metal. Plastic sleeves can be rotoform, collapsible or corrugated.

In preferred embodiments, the height of the base unit is at least about twenty-five percent of the height of the sleeve, and more preferably has a height in the range of about forty percent to about fifty percent of the height of the sleeve.

In preferred embodiments, a plastic liner bag is placed inside the two-part container and fresh, respiring produce is placed inside the liner bag. In such embodiments, the container has a height of about eighty-five inches, and a circumference of about one hundred seventy-six inches, and holds up to about two thousand pounds of Iceberg lettuce.

BRIEF DESCRIPTION OF THE DRAWINGS

The invention can better be understood by reference to the drawings in which.

DETAILED DESCRIPTION OF THE DRAWINGS

Figure 1:
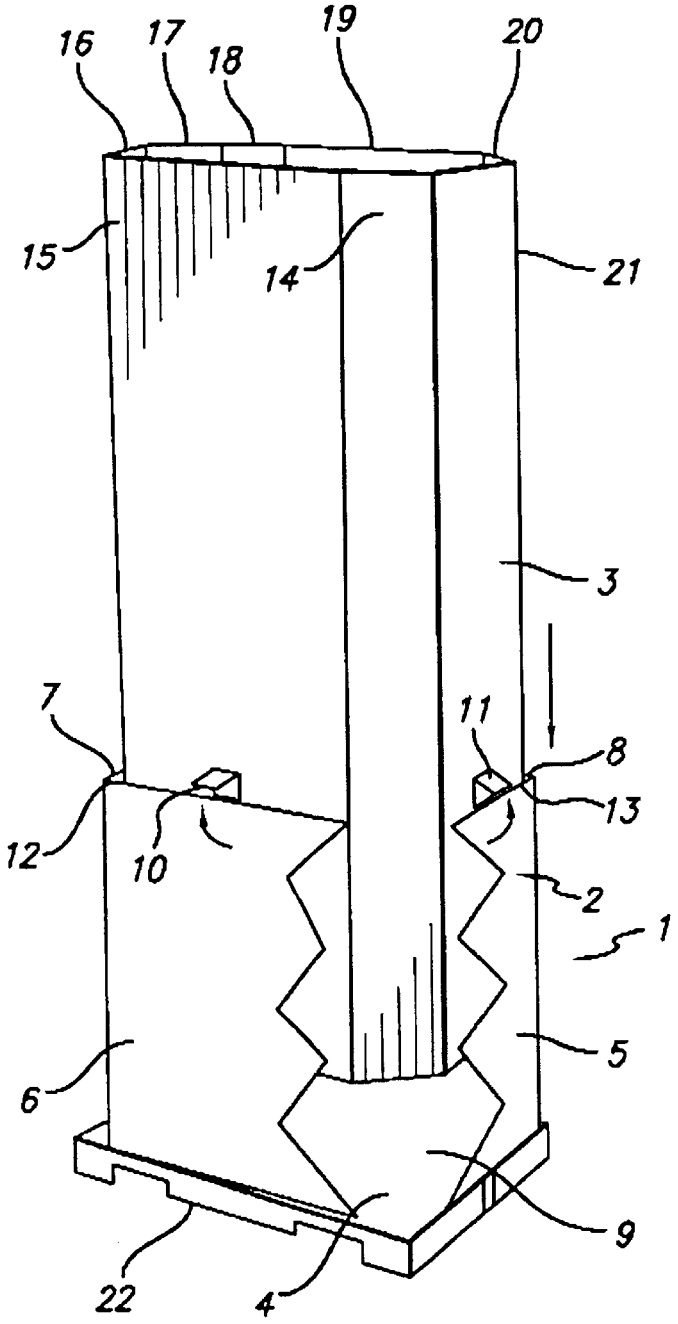
FIG. 1 shows an embodiment of a two-part container atop a pallet.
Figure 2:
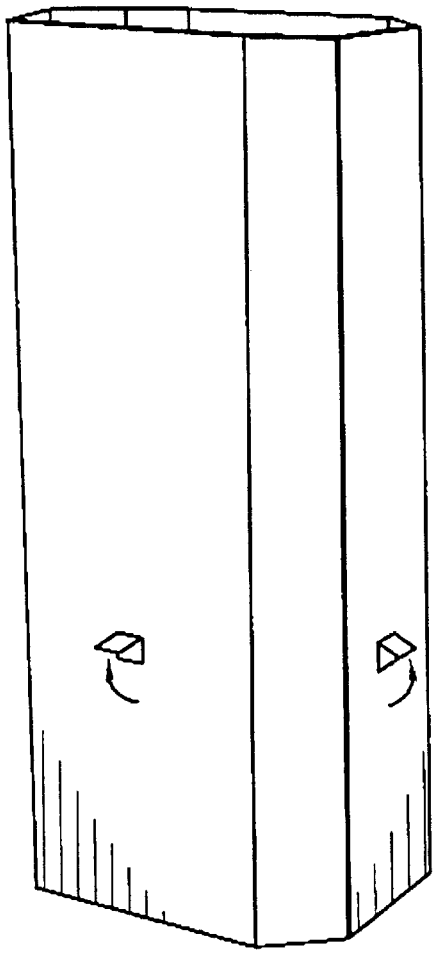
FIG. 2 shows the sleeve in the embodiment of FIG. 1.

The drawings show two-part container 1 including base unit 2 and sleeve 3. Base unit 2 includes bottom wall 4, and side walls 5, 6, 7 and 8. Cut-away area 9 shows that sleeve 3 fits frictionally inside base unit 2. Catch tabs 10 and 11 extending outwardly from the side walls of sleeve 3 engage upper edges 12 and 13 of base unit 2. Sleeve 3 has eight side walls 14, 15, 16, 17, 18, 19, 20, and 21. Sides 14, 20, and 21 and opposing sides 16, 17, and 18 are approximately the same size. Opposing sides 15 and 19 are larger in size then sides 14, 20, and 21. The diameter of sleeve 3 is approximately one hundred and seventy-six inches. The height of sleeve 3 is approximately eighty-five inches. The height of base unit 2 is approximately forty-one inches and its circumference is also approximately one hundred and seventy-six inches. Base unit 2 is shown resting upon pallet 22 and is preferably attached to pallet 22 by glue, nails, or other fasteners.

In use, container 1 has a liner bag placed within sleeve 3 and freshly harvested leafy produce such as lettuce heads are placed inside this bag.

What is claimed is:

1. A two-part container for fresh produce comprising a base unit having a bottom wall and four to eight side walls and a sleeve that fits frictionally inside said base unit, said container having sufficient capacity to hold hundreds of pounds of fresh produce, said sleeve including from four to eight side walls, said base unit having a height of at least about 25% of the height of the sleeve, and up to about 50% of the height of said sleeve.

2. The container of claim 1 wherein said base unit comprises four side walls, the sleeve comprises eight side walls, and is open at both ends.

3. The container of claim 1 wherein said base unit has a height that is at least about forty percent the height of the said sleeve.

4. The container of claim 1, wherein said base unit and said sleeve have the same number of walls, and each of the walls of said base unit and of said sleeve frictionally engage one another.

5. A two-part container for fresh produce comprising a base unit having a bottom wall and four to eight side walls, and a sleeve that fits frictionally inside said base unit, said sleeve including from four to eight side walls, said base unit having a height of at least about 25% of the height of the sleeve, and up to about 50% of the height of said sleeve, and further comprising catch tabs on at least four of the side walls of said sleeve, said tabs extending outwardly from said side walls a distance sufficient to engage the upper edges of the side wall of said base unit and to hold said sleeve above the bottom wall of, and within said base unit.

* * * * *